United States Patent [19]

Krenkel et al.

[11] Patent Number: 4,981,721

[45] Date of Patent: Jan. 1, 1991

[54] PROCESS FOR THE MANUFACTURE OF STRETCH RESISTANT, LIQUID IMPERMEABLE, FLEXIBLE PRESS BANDS, IN PARTICULAR FOR DEWATERING PRESSES OF PAPER-MAKING MACHINES

[75] Inventors: Bernhard Krenkel; Heinz Joos, both of Heidenheim, Fed. Rep. of Germany

[73] Assignee: F. Oberdorfer GmbH & Co. KG Industriegewebe-Technik, Heidenheim, Fed. Rep. of Germany

[21] Appl. No.: 399,525

[22] PCT Filed: Jan. 17, 1989

[86] PCT No.: PCT/EP89/00047

§ 371 Date: Sep. 18, 1989

§ 102(e) Date: Sep. 18, 1989

[30] Foreign Application Priority Data

Jan. 22, 1988 [DE] Fed. Rep. of Germany ..... 3801850

[51] Int. Cl.[5] ..... B05D 3/12; B05D 1/00; B05D 7/22

[52] U.S. Cl. ..... 427/171; 427/209; 427/210; 427/231; 427/276; 427/278; 427/365; 427/385.5; 427/430.1

[58] Field of Search ..... 427/209, 171, 210, 231, 427/276, 278, 365, 385.5, 430.1

*Primary Examiner*—Bernard Pianalto

*Attorney, Agent, or Firm*—Gifford, Groh, Sprinkle, Patmore and Anderson

[57] ABSTRACT

Process for the manufacture of stretch resistant, liquid impermeable, flexible press bands, in particular for dewatering presses of paper-making machines.

23 Claims, 2 Drawing Sheets

PROCESS FOR THE MANUFACTURE OF STRETCH RESISTANT, LIQUID IMPERMEABLE, FLEXIBLE PRESS BANDS, IN PARTICULAR FOR DEWATERING PRESSES OF PAPER-MAKING MACHINES

The invention concerns a process for the manufacture of stretch resistant, liquid impermeable, flexible press bands, especially for dewatering presses of paper-making machines according to the preamble of claim 1, as well as an apparatus for practising that process.

Press bands which are manufactured according to that process are known from German published application (DE-OS) No. 32 24 760. They are usually coated by pouring a plastic material onto a reinforcing structure, so that the reinforcing elements of the reinforcing structured web are at least partly imbedded into the plastic material.

According to German published application (DE-OS) No. 33 18 984 the plastic material is poured in such a way that the pouring jet strikes the reinforcing fabric band covering a horizontal cylinder which rotates about its longitudinal axis moving slowly and parallel to the cylinder axis, or the pouring of the plastic material is practised such that the pouring jet enters a vertically or inclined positioned mold, containing the reinforcing fabric band in form of one or several fabric layers of threads consisting of one or more materials such as polyamide, polyester, Kevlar, metal and others or mixtures thereof.

The above mentioned process is disadvantageous therein that a press band which has been coated in such a way is provided with a smooth outer surface, whereas the inner surface of the band is provided with the requested hollow spaces and/or depressions for feeding away the liquid. In order to make possible the use of such a manufactured press band on a dewatering press the band must be turned around after its removal from the mold in order to put the structured surface of the band corresponding originally to the inner surface of the band outwardly or to change the inner surface of the band to become the outer surface of the band, whereas the smooth surface becomes the inner surface of the band. This is because the structured outer surface of such press bands opposing to the bandlike fiber material or opposing to the felt fabric serves for the removal of the liquid. The turning around of finished poured press bands, however, is especially in cases of small band diameters very problematical and requests doubtlessly an essential effort, moreover not excluding the risk that the press band is damaged during such a turning around operation.

It has therefore also been proposed to avoid the turning around of the band completely and instead thereof to grind or cut the required dewatering channels into the smooth outer surface of the press band. This kind of manufacturing, however, is a time and cost consuming procedure.

The object of the invention is therefore to be seen therein to amend the process of the above mentioned type such that those press bands, especially extended nip-press bands, which must be provided on the surface opposing to the press felt with hollow spaces and/or depressions for the dewatering of the liquid, can be manufactured in an essentially simpler way without requesting for that purpose costs concerning the apparatus which are inadequately high. The apparatus which must also be developed for that purpose should correspond to that requirement.

The object is solved according to the invention by guiding the reinforcing web band over a roll equipment provided with at least two distantly arranged rolls positioned parallel to one another and one over the other or adjacent to one another, wherein the surface of the band is coated through at least one nozzle on the outer side of the band or inner side of the band or on both sides of the band by a flowable mixture of a prepolymer.

In order to pratice the process according to the invention an apparatus is used, characterized by a roll equipment provided with at least two rolls distantly arranged in parallel one over the other or adjacent to one another, at least one of said rolls is driven, and further characterized by a coating equipment provided with at least one mixing head for the coating material, especially a prepolymer, which coating equipment having a broad slot nozzle connected thereto, the product exit opening thereof can be directed against the surface of a reinforcing web band, which band can be extended over the rolls for the purpose of coating by a prepolymer.

By that process a reinforced web band may be continuously coated for instance on a roll equipment consisting of two rolls distantly arranged adjacent to one another or one over the other, which band is running over the rolls and attains a position under the broad slot nozzle spending the flowable prepolymer mixture in a jet-like manner, which jet extends over essentially the entire width of the band. The prepolymer which is thus put onto the one surface of the band is at least partly pressed through the meshes of the web of the band by the pressure of pouring. Because of this on the surface of the band which is opposite to the pouring jet hollow spaces are remaining providing the band with the required structure for leading away water or storing water, respectively.

According to an advantageous embodiment of the process the flowable prepolymer mixture is applied by a broad slot nozzle onto the inner surface of the reinforcing web band opposite to the roll surface, and suitably directly into the nip, formed by the roll surface and the inner surface of the reinforcing web band, so that a portion of the flowable prepolymer is pressed through the apertures of the web of the band and onto the outer surface of the reinforcing web band coating that surface when the coated inner surface of the band comes in contact with the surface of the roll turning round the band.

Because of the fact that the pressing through of the flowable prepolymer through the apertures of the web or the meshes from the one side to the other essentially depends on the height of the pressure by which the reinforcing web band is forced onto the surface of the roll it was found out to be advantageous to control that pressure by changing the tension of the web, for instance by changing the distance of the rolls.

Advantageous embodiments of the apparatus which is used for the prosecution of the process according to the invention are characterized by the claims 8 through 17. These embodiments may inter alia differ from one another by the fact that the broad slot nozzle is positioned either above the outer surface of the band or the inner surface of the band, so that the still flowable prepolymer applied to the surface of the band is poured by means of the jet pressure or pouring pressure of the nozzle flowing from the outer surface of the band through the apertures of the web or meshes to the inner surface of the band in order to get in touch there with the surface of the roll or is fed at first to the inner surface of the band so that it is because of the pressure between the surface of the roll and the surface of the band within the nip formed by both parts pressed through the apertures of the web or meshes and fed onto the outer surface of the band.

The last mentioned case has been found out and has been proved to be especially advantageous to position the broad slot nozzle such that the exit opening of the nozzle is immediately directed into the roll nip formed by the reinforcing web band and the roll.

The invention is explained in detail in the following in connection with an embodiment shown in the drawings.

DETAILED DESCRIPTION OF THE DRAWINGS

Figure 1:
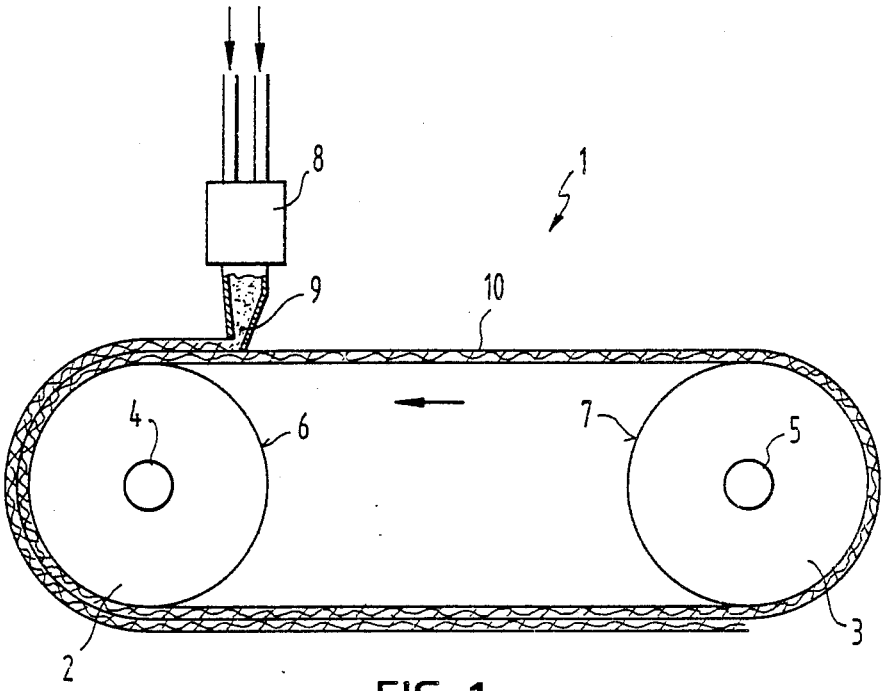
FIG. 1 is a schematic lateral view of the apparatus according to the invention, consisting of a roll equipment provided with two rolls, and a mixing head provided with a broad slot nozzle positioned over the upper surface of the reinforcing web band running over the roll.

For the manufacture of a stretch resistant, liquid impermeable, flexible, elastic press band which is especially suited for extended press nips of wet presses for paper-making machines, a reinforcing web band referenced in FIG. 1 by 10 is drawn over to distantly adjacent positioned rolls 2, 3, the axes 4, 5 of which are parallel to one another, the distance of the axes, however, can be changed by means not shown, so that different lengths of the band of the endless reinforcing web band can be coated.

At least one of the two rolls 2, 3 is driven, so that the reinforcing web band is fed over the surfaces 6, 7 of the roll in the direction of the arrow.

Above the outer surface of the reinforcing web band 10 in the range of the one roll 2 a mixing head 8 is positioned containing the components of a prepolymer, for instance polyurethane, and delivering the flowable mixture to the broad slot nozzle arranged underneath, which nozzle extends over at least the whole width of the reinforcing web band to be coated. The product exit opening of that broad slot nozzle is directed against the surface of the reinforcing web band, and the prepolymer leaving that opening is applied to the outer surface of the band as a layer having a requested thickness, so that a portion of the flowable prepolymer is pressed by a pouring pressure through the meshes of the web to the inner surface of the band opposite to the roll surface 6. In each case the prepolymer mass which is pressed from the outer surface of the reinforcing web band through the meshes of the web is controlled such that both surfaces of the band are simultaneously coated by one operation with that prepolymer. The speed of the band is adapted to the coating process insofar as after the beginning of the movement of the band in the direction of the arrow shown in FIG. 1 and after the beginning of the coating the coated portion of the band is continuing to be slowly fed by the front roll 2, leaving thereafter the surface 6 of that roll. For that purpose the surface of the roll may be provided with a special separating substance, for instance a silicone oil, in order to assist the separation of the coated reinforcing web band.

The coated band moves thereafter onto the surface 7 of the second roll 3 transporting it back to the starting point, i.e. the coating station. As soon as the revolution is concluded, the reinforcing web band is finished coated and can be taken off the rolls after the polyurethane is cured.

Figure 5:
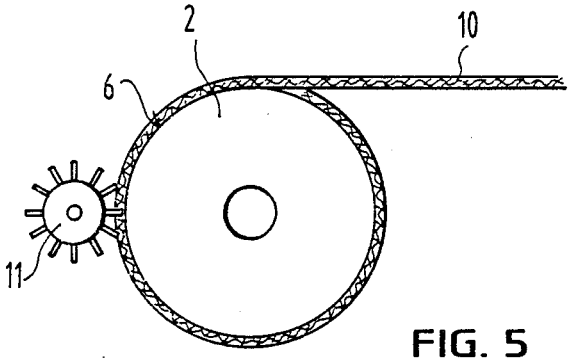
FIG. 5 is a schematic partial lateral view of the apparatus according to the invention in compliance with the embodiments according to FIGS. 1 and 2, provided with a profile body in form of a roll having pins in accordance with FIG. 3 which profile body is positioned over the coated reinforcing web band adjacent to a roll.

In order to provide the outer surface of the coated reinforcing web band with a water storing or water delivering structure, the profile body in form of a roll 11 provided with pins 12 can be positioned over the coated band surface as shown by FIG. 5. This profile body rams with its pins 12 into the still flowable layer of prepolymer on rolling over that layer and forms therefore into that layer the required structure.

Figure 3:
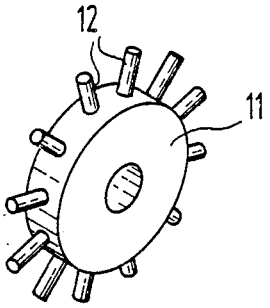
FIG. 3 is a schematic plan view of a profile body in form of a roll provided with pins.
Figure 4:
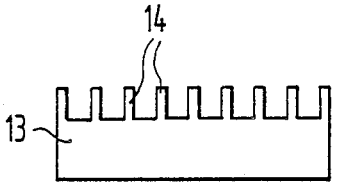
FIG. 4 is a schematic plan view of a profile body in form of a forming sheet provided with ribs.

Instead of the roll of FIG. 3 functioning as profile body, a profile body which is configured for instance as a forming sheet may also be used which is for that purpose provided with ribs, as shown in FIG. 4, taking over the function of the pins 12 of the roll 11.

Figure 2:
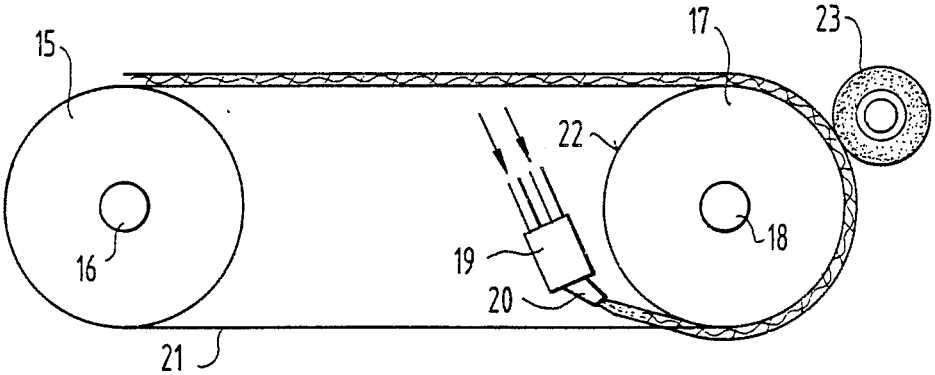
FIG. 2 is a schematic lateral view similar to that one of FIG. 1 of another embodiment of the apparatus according to the invention, in which the broad slot nozzle is positioned at the lower surface of the reinforcing web band in the area of the nip formed between that band and the roll surface.
Figure 6:
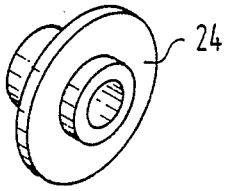
FIG. 6 is a schematic perspective view of a profile body in form of a roll provided with an embossed disc.

The apparatus as schematically shown in FIG. 2 for the manufacture of stretch resistant, liquid impermeable, flexible, elastic press bands which are especially suited for wet presses of paper-making machines having an extended press-nip, so called broad-nip presses, used in the first press position of paper-making machines, is principally similar structured as the apparatus shown in FIG. 1 with exception of the arrangement of the mixing head, especially, however, the broad slot nozzle, from which the flowable prepolymer mixture is delivered to the surface of the reinforcing web band to be coated. In such a case the broad slot nozzle 20 connected to the mixing head 19 is positioned with its product delivering opening at that inner surface of the reinforcing web band 21 which is opposite to the surface 22 of the roll, such that the prepolymer mixture which is in this case, too, polyurethane, is directly poured into the nip provided by the surface 22 of the roll and the inner surface of the reinforcing web band. In such a case, the prepolymer mixture at first arrives at the inner surface of the band in front of the surface of the roll.

As soon as that coated inner surface of the band is then touched by the surface 22 of the roll 17, at least a portion of the still flowable prepolymer is pressed through the apertures of the web or meshes of the band onto the outer surface of the band in order to coat that outer surface. The such coated band may be as in case of the embodiment according to FIG. 1 provided on its outer surface with a structure, in case that structure is not developed from the first of the beginning by the fact that the prepolymer mass extending through the web apertures or meshes, respectively, does not extend completely over the whole surface of the band, but leaves dependent on the width of the meshes and the structure of the web depressions or channels which then serve as a water storing space for the surface of the band opposite to the felt of the wet press. In case of the apparatus disclosed by FIG. 2 the roll equipment 1 of FIG. 1 is also provided with two rolls 15, 17, rotating about parallel axes 16, 18, at least one of which is driven, the reinforcing web band moves after it has been coated only one time around the roll until it reaches the starting point, i.e. the coating station, shown by the mixture head 19 and the broad slot nozzle 20, in order to be taken off the rolls after curing.

Instead of only one broad slot nozzle several nozzles could also be used, although not shown in the drawings, which nozzles are arranged either adjacent to one another or in serie behind one another and could be supplied with coating material by one or more mixing heads. For the establishing of a required surface structure for water delivering or water storing purposes, respectively, also in this case profile bodies, for instance of such a type as shown by FIGS. 3 and 4, could be used which provide in a still plastically deformable outer surface of the band corresponding depressions.

In case the outer surface of the band must be ground the apparatus according to the embodiment of FIG. 1 as well as of that of FIG. 2 could be doubtlessly provided with a grinding equipment, which is shown in FIG. 2 only schematically and referenced there by 23 and which fulfills the required grinding operations on the coated reinforcing web band passing underneath that equipment.

Instead of the profile body in form of a roll 11 as shown in FIG. 5, the surface of which is provided with pins 12, such a roll may be provided with at least one embossing disc 24 leaving impressions in the still flowable layer of prepolymer on the coated surface of the reinforcing web band in order to configure the required depressions in form of grooves, notches and others for dewatering purposes.

In case the pressure between the surfaces of the two rolls 6, 7 and the reinforcing web band 10 is to be changed, the tension of the reinforcing web band is changed by increasing or decreasing the distance between the two roll axes 4, 5 by means of a device not shown here.

Moreover, it is possible to adapt the thickness of the coating as well as the surface of the coating on the reinforcing web band 10 at the felt-confronted side to required conditions by a calibration roll not shown in the drawings, i.e. to increase or decrease or, with respect to the surface condition of the coating, respectively, to smooth or condition it in another way, wherein smoothing means that the depressions in the surface of the band are so small that they are neglectable, i.e. the surface of the band can be designated as to be practically completely smooth. In case such a smooth surface of the band is required from the first of the beginning, it goes without saying that no profiles are configured into the still flowable coating material on the surface of the reinforcing web band.

Because of the fact that the invention takes the position that the reinforcing web band is either on the outer surface of the band or on the inner surface of the band or on both surfaces coated with a flowable prepolymer mixture, in case of a coating of both sides the outer surface of the band and the inner surface of the band can be simultaneously coated. For that purpose the embodiments of the coating equipments shown in FIGS. 1 and 2, for instance, can be used in combination with one another not only in case of the simultaneous coating of both surfaces of the band but also in case of possible coatings succeeding one another different prepolymers as coating masses can doubtlessly also be applied to the two surfaces of the band, whereby the difference between these prepolymers could especially be in their different hardnesses after curing has been finished.

Finally, it has also been advantageous without showing this expressively in the drawings to define the impregnating depth of the coating material within the reinforcing web band by a blocking layer within that band which can be provided in a fabric consisting of one layer as well as in fabrics consisting of several layers, which are to be coated with the prepolymer.

Although in the drawings for both embodiments of the apparatus according to the invention as shown by FIGS. 1 and 2 only one nozzle is disclosed as coating means, this does not mean that not also several nozzles could be arranged in running direction of the reinforcing web band 10 one behind the other and/or adjacent to one another. The last mentioned possibility can especially be used in such a case in which instead of a broad slot nozzle several nozzles are used provided with different exit opening configurations.

We claim:

1. A process for the manufacture of a stretch resistant, liquid impermeable, flexible press band, especially for a dewatering press of a paper-making machine having an extended press nip, which press band is a fiber band providing passages between fibers of the band for the purpose of carrying off liquid on at least one of the outer surfaces of the band, comprising pouring a flowable mixture of a prepolymer onto an endless reinforcing web of said fiber band and connecting it thereto, characterized in that the reinforcing web band is guided over at least two spaced parallel rolls and that a surface of the band is coated by at least one nozzle with said flowable prepolymer mixture.

2. Process according to claim 1, characterized in that the flowable prepolymer mixture is applied through at least one said nozzle onto the inner surface of the reinforcing web band which engages the surface of one of said rolls and a portion of the flowable prepolymer is pressed through the passages between fibers of the band to the outer surface of the reinforcing web band for coating it, when the coated inner surface of the band contacts the surface of said roll.

3. Process according to claim 2, characterized in that the flowable prepolymer mixture is directly applied by means of a broad slot nozzle into the gap formed by the roll surface and the inner surface of the reinforcing web band.

4. Process according to claim 1 characterized in that the pressure between the rolls and the reinforcing web band is controlled by changing the tension of the web.

5. The process according to claim 4, wherein the tension of the web is controlled by varying the spacing between said rolls.

6. Process according to claim 1 characterized in that a coating is applied to the outer surface of the band as well as the inner surface of the band simultaneously.

7. Process according to claim 6, characterized in that the two coatings are applied with different prepolymers.

8. Process according to claim 7, characterized in that the prepolymers differ with respect to their hardnesses.

9. The process according to claim 1, wherein said web is moved by driving one of said rolls and said flowable prepolymer mixture is supplied to at least one nozzle from a mixing head.

10. The process according to claim 9 wherein said nozzle has a broad slot and is positioned over the inner surface of the web confronted with the surface of the roll, the exit opening of the broad slot nozzle being precisely directed into the gap of the rolls formed by the web and the roll.

11. The process according to claim 9, wherein said rolls are provided with a separating substance avoiding sticking of said web on the roll surfaces during the coating.

12. The process according to claim 1, wherein said outer surface of the web is coated.

13. The process according to claim 1, wherein a profiling element is brought into engagement with the coating after it has been applied to the web surface and while it is still flowable forming into the surface of the web an indentation pattern used for carrying off water or storing water.

14. The process according to claim 13, wherein said indentation pattern is formed by contacting the web with a roll having pins.

15. The process according to claim 13, wherein said indentation pattern is formed by at least one embossing disk.

16. The process according to claim 13, wherein said indentation pattern is formed by a forming sheet provided with ribs.

17. The process according to claim 1 wherein said fiber band is a felt fabric.

18. The process according to claim 1 wherein said prepolymer mixture is a polyurethane.

19. The process according to claim 1 wherein said rolls are arranged in a horizontal plane.

20. The process according to claim 1 wherein said rolls are arranged in a vertical plane.

21. The process according to claim 1 wherein the surface of the band which is coated is the outer surface of the band.

22. The process according to claim 1 wherein the surface of the band that is coated is the inner surface of the band.

23. The process according to claim 1 wherein both the inner and outer surface of the band is coated.

* * * * *